US007203999B2

(12) United States Patent
Bagot

(10) Patent No.: US 7,203,999 B2
(45) Date of Patent: Apr. 17, 2007

(54) BUTTON PROTECTOR FOR LAUNDERING, DRY-CLEANING AND IRONING OPERATIONS

(76) Inventor: Valerie P. Bagot, 880 Bogert Rd., River Edge, NJ (US) 07661

( * ) Notice: Subject to any disclaimer, the term of this patent is extended or adjusted under 35 U.S.C. 154(b) by 0 days.

(21) Appl. No.: 10/223,528

(22) Filed: Aug. 20, 2002

(65) Prior Publication Data

US 2004/0034971 A1 Feb. 26, 2004

(51) Int. Cl.
*A44B 1/16* (2006.01)
*A44B 1/14* (2006.01)

(52) U.S. Cl. ..... 24/113 R; 24/90.1; 2/46

(58) Field of Classification Search ..... 2/46; 24/90.1, 90.5, 113 R, 113 MP, 114.7, 114.9, 24/DIG. 29; 79/1; 119/770; 451/448; D11/220, D11/222, 228
See application file for complete search history.

(56) References Cited

U.S. PATENT DOCUMENTS

| | | | | | |
|---|---|---|---|---|---|
| 502,201 | A | | 7/1893 | Pilbeam | |
| 569,675 | A | | 10/1896 | Seiler | |
| 572,796 | A | | 12/1896 | Gross | |
| 702,278 | A | * | 6/1902 | Bascom | 451/448 |
| 2,024,533 | A | * | 12/1935 | Manoogian | 68/235 R |
| 2,125,354 | A | | 8/1938 | Meier | 150/10 |
| 2,189,467 | A | * | 2/1940 | Jacobs | 68/235 R |
| 2,214,030 | A | * | 9/1940 | Pereles | 40/315 |
| 2,577,723 | A | | 12/1951 | Groh | 24/113 |
| 2,667,906 | A | | 2/1954 | Stiller | 150/37 |
| 2,674,771 | A | | 4/1954 | Novick | 24/113 |
| 2,909,203 | A | | 10/1959 | Reaves | 150/37 |
| 3,087,215 | A | * | 4/1963 | Tworek et al. | 24/113 R |
| 3,206,818 | A | * | 9/1965 | Knowlton | 24/693 |
| 3,584,349 | A | | 6/1971 | Shubart | 24/113 |
| 3,648,331 | A | * | 3/1972 | Kruger et al. | 24/113 R |
| 3,757,388 | A | | 9/1973 | Wolny | 24/113 R |
| 3,777,336 | A | | 12/1973 | Anderson | 24/113 MP |
| 3,787,935 | A | * | 1/1974 | Kapitan | 24/113 MP |
| 4,033,012 | A | | 7/1977 | Kramer et al. | 24/90 D |
| 4,283,815 | A | * | 8/1981 | Henshaw | 24/114.3 |

(Continued)

FOREIGN PATENT DOCUMENTS

| | | | | | |
|---|---|---|---|---|---|
| JP | 402185203 | A | * | 7/1990 | 79/1 |

(Continued)

*Primary Examiner*—Robert J. Sandy
*Assistant Examiner*—Andre' L. Jackson
(74) *Attorney, Agent, or Firm*—Ernest D. Buff & Associates, LLC; Ernest D. Buff; Margaret A. LaCroix

(57) ABSTRACT

A detachable, heat resistant, flexible button protector protects against button degradation during laundering, dry-cleaning or hot ironing operations. The protector has an enclosure for forming a cavity surrounding at least one button. A slit in the side of the enclosure accommodates insertion of the button into the cavity. Button degradation is prevented by sealing the enclosure to minimize penetration of cleaning fluids during insertion and residence of the button within the cavity. The protector shields the button from corrosive laundering and dry-cleaning chemicals, while allowing entry of chemicals that wash the fabric on which the button is sewn. It is strong enough to withstand compressive force and shock impact produced by laundering machinery. Chipping and chemical degradation of buttons is virtually eliminated. Laundering, dry-cleaning and ironing operations are carried out economically in an efficient, reliable manner.

7 Claims, 4 Drawing Sheets

U.S. PATENT DOCUMENTS

| | | | | | |
|---|---|---|---|---|---|
| 4,539,731 | A | | 9/1985 | Torrini | 24/92 |
| 4,580,320 | A | | 4/1986 | Takata | 24/113 MP |
| 4,654,934 | A | | 4/1987 | Hasegawa | 24/113 R |
| RE32,500 | E | | 9/1987 | Takata | 24/113 MP |
| 4,739,877 | A | | 4/1988 | Olson | 206/38.1 |
| 4,918,791 | A | | 4/1990 | Hardin | 24/90.5 |
| 5,044,012 | A | * | 9/1991 | Antonio | 2/46 |
| 5,060,356 | A | * | 10/1991 | Szedzinski | 24/113 MP |
| 5,161,285 | A | | 11/1992 | Jerjian | 24/113 R |
| 5,199,136 | A | | 4/1993 | McNerney et al. | 24/90 TA |
| 5,472,281 | A | | 12/1995 | Phelps | 383/43 |
| 5,621,951 | A | | 4/1997 | Gould | 24/90.5 |
| 5,687,879 | A | * | 11/1997 | King et al. | 222/108 |
| D396,202 | S | * | 7/1998 | Lindsay | D11/228 |
| 5,901,417 | A | | 5/1999 | Alexiou | 24/90.5 |
| 5,956,816 | A | | 9/1999 | McCrink | 24/113 MP |
| 6,298,493 | B1 | * | 10/2001 | Ambroise | 2/209 |

FOREIGN PATENT DOCUMENTS

| | | | | |
|---|---|---|---|---|
| JP | 411276769 | A | * | 3/1998 |
| JP | 10-234427 | | * | 9/1998 |
| JP | 10262708 | A | * | 10/1998 |
| JP | 11-207080 | | * | 8/1999 |

* cited by examiner

BUTTON PROTECTOR FOR LAUNDERING, DRY-CLEANING AND IRONING OPERATIONS

BACKGROUND OF THE INVENTION

1. Field of the Invention

The present invention relates to articles for garment protection; and more particularly, to a removably attached, heat resistant, flexible button protector that slips over and protects one or more groups of buttons on articles of clothing during laundering, dry-cleaning and hot ironing operations.

2. Description of the Prior Art

The need to protect buttons on articles of clothing during laundering, dry-cleaning and hot ironing operations has been long recognized. It is particularly acute with commercial laundering services, where loss, breakage and degradation of buttons result in significant costs, and delays fulfilling orders. Button degradation includes chipping and partial breakage, chemical attack and discoloration of buttons composed of plastic material, as well as heat damage causing melting, warping and the like. In many cases, buttons have unique shapes and sizes, and cannot be readily matched. With more expensive articles of clothing, which are imported, it is practically impossible to match broken or damaged buttons since offshore button manufacturers are generally unavailable to provide replacements.

Button breakage and protection problems have been previously addressed by the art. The approaches employed for this purpose include: a) use of button materials that are more stable against chemical attack and heat resistance, with good strength and fracture toughness properties; and b) use of enclosing devices (typically rigid, non-flexible solid structures) around buttons during the laundering, dry-cleaning and ironing operations. Numerous patents disclosing enclosures and pouches for button protection are extant in the art.

Attempts to improve the strength, chemical resistance and or heat resistance of the buttons, themselves, have been disclosed. Traditionally buttons were constructed from mother of pearl, which exhibits good strength properties, chemical resistance and heat resistance properties. Manufacture of mother of pearl buttons is labor intensive, and buttons thus made cannot be easily colored. Metallic buttons have been used, due to their strength and heat resistance properties; but tend to corrode when subjected to successive laundering operations. Polymeric materials used for button construction range from thermoplastics to thermosets. Thermoplastic materials are easily molded; but suffer from low heat resistance. Thermosets discolor and become brittle, causing them to chip or break when subjected to heat. In general, thermoplastic resins include acrylic polymers, while thermosets include polyesters. Ceramic buttons using partially stabilized zirconia or alumina have been employed, and the strength and fracture toughness, chemical inertness and heat resistance of ceramic buttons is well documented.

A first group of patents teach using diverse materials for construction of buttons, including metal, plastic fabric or ceramic rather than removable button protectors. In U.S. Pat No. 4,580,320, U.S. Pat. No. Re. 32,500, U.S. Pat. No. 2,674,711, and U.S. Pat. No. 4,654,934, the button head material is selected for ornamental purposes. U.S. Pat. No. 5,199,136 discloses constructing a button head from ceramic material to increase its resistance to deterioration from heat and chemical attack. In U.S. Pat. No. 5,956,816 the button head includes a coating composed of a silicone elastomer that provides a "soft-to-the-touch' feel, while protecting the underlying metal button head from corrosion.

A second group of patents discloses encasing the buttons to increase ornamental appeal or provide protection during laundering, dry-cleaning or hot ironing procedures. U.S. Pat. No. 502,201 discloses a rigid, non-flexible, button cover, which slides over a button to improve its appearance and provide ornamental value. The button cover does not protect the button during laundering, dry-cleaning or hot ironing operations. U.S. Pat. No. 2,577,723 discloses ornamental rigid, non-flexible, button covers that improve the appearance of fabric, plastic or bone buttons. U.S. Pat. No. 3,584,349 discloses a flexible plastic sheet made from polyethylene or nylon. The plastic sheet protects buttons during laundering. Due to the plastic's low temperature capability the sheet cannot tolerate harsh solvents of dry-cleaning, or withstand a hot ironing operation. In U.S. Pat. No. 3,757,388, a hinged rigid non-flexible box composed of thermoplastic material encases a button during laundering. Due to its non-flexible property and large size the box prevents hot ironing and steam pressing operations. In addition, the themoplastic box material cannot withstand the heat produced during ironing, or tolerate the chemical attack caused by dry-cleaning solvents. U.S. Pat. No. 3,777,336 discloses a button cover that provides ornamental value. No protection is provided to the button during laundering, dry-cleaning or hot ironing operations. U.S. Pat. No. 4,539,731 discloses a button cover having the form of a rigid, non-flexible box. The button cover is, optionally, made from precious metals, and improves the appearance of the button. It is not intended to protect the button during laundering, dry-cleaning or hot ironing operations. U.S. Pat. No. 4,918,791 to Hardin discloses a clothing button guard having the form of a cup shaped container. A cylindrical side of the cup is provided with a slit to slip the guard over a button. The guard is capped, and is intended to protect the button during laundering. In practice, however, the slit tends to allow dry-cleaning fluids to chemically attack the button. Moreover, the rigid, non-flexible, bulky button guard prevents hot ironing or steam pressing operations. U.S. Pat. No. 5,161,285 discloses button cover having a box construction, and adapted to be slid over a button. This box cover is employed for ornamental purposes, being made from precious metals with gem stone decorations. The rigid, non-flexible bulky button cover is not used to protect the button during laundering or dry-cleaning, and its bulky size and rigid non-flexible construction impede hot ironing or steam pressing operations. U.S. Pat. No. 5,621,951 discloses a device for covering and concealing buttons, in which a plastic sliceable cylindrical box construction snaps over a button. The device is cosmetic in nature and does not function as a button protector during laundering, dry-cleaning or hot ironing operations. Due to the large opening through which the button is inserted, laundry and dry-cleaning chemicals can easily enter the box interior, wherein they chemically attack the button, degrading its appearance. Moreover, the large, bulky size of the box, and the thermoplastic material from which it is constructed, prevent hot ironing and steam pressing operations. U.S. Pat. No. 5,901,417 discloses a detachable button protector having the form of a hinged cylindrical box, with hinge and snapping regions located on a cylindrical surface designed to snap over one or more buttons. The device protects buttons from breakage, and is said to be used during a laundering operation. A plurality of holes on the periphery of the cylinder vent the central cavity. The holes allow entry of harsh chemicals, typically dry cleaning and laundering ingredients, which chemically attack the button. The bulky box impedes hot ironing and steam pressing operations.

A third group of patents relates to elastomeric pouches and containers. None of these patents teach using an elastomeric pouch or container to provide a button protecting function. U.S. Pat. No. 569,675 discloses a metallic pocket coin holder that is rigid and non-flexible. U.S. Pat. No. 572,296 discloses a combined puzzle purse and receptacle. The purse is opened by grasping the outer edges of the pouch. U.S. Pat. No. 2,125,354 discloses an oval container for holding keys, and the like. The edges of the container are pressed to open a central slit. U.S. Pat. No. 2,667,906 discloses an oval self-closing container, for holding coins and the like. U.S. Pat. No. 2,909,203 discloses a decorative rubber coin purse having reinforcement springs. U.S. Pat. No. 4,739,877 discloses a combination ring and cardholder, in which the credit card holding, stretchable pouch is attached to a key ring. U.S. Pat. No. 5,472,281 discloses a self-closing protector receptacle and method of making the same. Pressing the receptacle perpendicular to its length direction opens a slit to accept objects such as jewelry. This rectangular device is self-closing. On releasing the edges, the receptacle closes due to spring action.

There remains a need in the art for a method and means for protecting buttons on articles of clothing during laundering, dry-cleaning and hot ion pressing operations. A button protector should be a flexible, low profile article, occupying minimal space, and composed of a heat and corrosion resistant material. The protector should shield the button from corrosive laundering and dry-cleaning chemicals, while allowing entry of chemicals that wash the fabric on which the button is sewn. The protector must be strong enough to withstand compressive force and shock impact produced by laundering machinery, to prevent chipping of buttons.

SUMMARY OF THE INVENTION

The present invention provides a method and means for protecting buttons on articles of clothing during laundering, dry-cleaning and hot ion pressing operations. Protection is provided by a flexible, low profile article that occupies minimal space, and is composed of a heat and corrosion resistant material. The protector shields the button from corrosive laundering and dry-cleaning chemicals, while allowing entry of chemicals that wash the fabric on which the button is sewn. It is strong enough to withstand compressive force and shock impact produced by laundering machinery. Chipping and chemical degradation of buttons is virtually eliminated. Laundering, dry-cleaning and ironing operations are carried out economically in an efficient, reliable manner.

Generally stated, there is provided a button protection device, comprising a flexible protective cover composed of a heat resistant material. Such a material consists essentially of a composition containing silicone, Teflon or other fluorocarbon capable of withstanding temperatures over 800F, which are commonly encountered during ironing operations. Means are provided for preventing water or dry-cleaning fluids from wetting the interior of the protective cover. The button is inserted into the protective cover though a small slit therein. Such means minimizes the opening in the protective cover, barring entry of water or chemical reagents into the button enclosure during laundering or dry-cleaning operation. The button protector is, optionally, made from a fabric coated with a high temperature water repellent coating, or molded directly from the polymer. If the device is made from coated fabric, the edges are sewn or polymer glue bonded to form the button protection device as described hereinafter in greater detail, and the sewn edges are sealed to prevent seepage of laundering and dry-cleaning chemicals. Molded polymer covers can be molded as a single piece, or glue bonded, or thermally fused. The button protector can be sized to encase one button, or to cover several buttons in a row.

In its simplest form, the button protector comprises an enclosed cavity having a slit-like opening. The button is inserted through the slit, so that the protector hangs on the button, surrounding and enclosing the button within a cavity. With this arrangement, the button holding threads pass through a mini-slit in at least one side of the protector. If the protector is immersed in a liquid medium such as laundry and dry-cleaning fluids, the minimal slit size enables the non-wetting, repellant surfaces of the protection device to prevent corrosive fluids from entering the button enclosure. In one embodiment, a plurality of flaps, defining the slit, overlap so that the overlapping surfaces prevent fluid penetration. A small opening, or mini-slit, in at least one of the flaps enables button-holding thread to pass therethrough. In another embodiment, one of the flaps has a pair of mini-flaps disposed on its top and bottom sides. These mini-flaps are composed of overlapping sheets of coated fabric, or a first sheet of coated fabric coupled with a molded high temperature polymer sheet present on the matching side; and cooperate in combination to form an outer edge portion of the slit. A small opening, or mini-slit, leading from the outer edge portion to a portion of at least one flap located central of the cavity enable button-holding thread to pass through the mini-slit. Complete enclosure of the slit and mini-slit openings bars entry of cleaning fluids into the protector interior.

BRIEF DESCRIPTION OF DRAWINGS

The invention will be more fully understood and further advantages will become apparent when reference is had to the following detailed description and the accompanying drawings, in which:

FIG. 3A is a plane view depicting the bottom of a single-bottom protector of the invention; with the button and button holding threads passing through the slit and mini-slit openings; in which

DESCRIPTION OF THE PREFERRED EMBODIMENTS

The present invention provides a flexible, easily detachable button protector especially suited for use during laundering dry-cleaning or hot iron processing of garments. The button protector forms an envelope, which is composed of a flexible material with repellent properties for common laundry cleaning or dry-cleaning fluids. It surrounds the button, thereby providing a flexible, fluid repellent enclosure that prevents entry of cleaning fluids. The button is inserted into a cavity of the protector through a slit-like opening sized to accommodate passage of the button therethrough. A mini-slit is provided on at least one side of the envelope to accommodate threads holding the button to the garment. Creation of a minimal slit opening prevents entry of fluids into the cavity. In a first embodiment, the slit is formed by two overlapping flaps on one side of the protector. Hydraulic pressure in the cleaning fluid operates to close the overlapping flaps, thereby preventing entrance of cleaning fluid into the cavity. In another embodiment, the slit-forming flaps are covered on their outer sides by a set of overlapping mini-flaps attached to opposing outer sides of the flaps. In all cases, there is provided a mini-slit leading from an outer edge of the protector toward a central portion of at least one flap and mini-flap assembly, to accommodate movement of button threads during insertion of the button into the cavity. Were it not for the mini-slit, these button threads, which secure the button to the garment, would apply undue pressure against the flaps, causing the slit to open enough to permit penetration of cleaning fluids into the cavity.

Figure 1A:
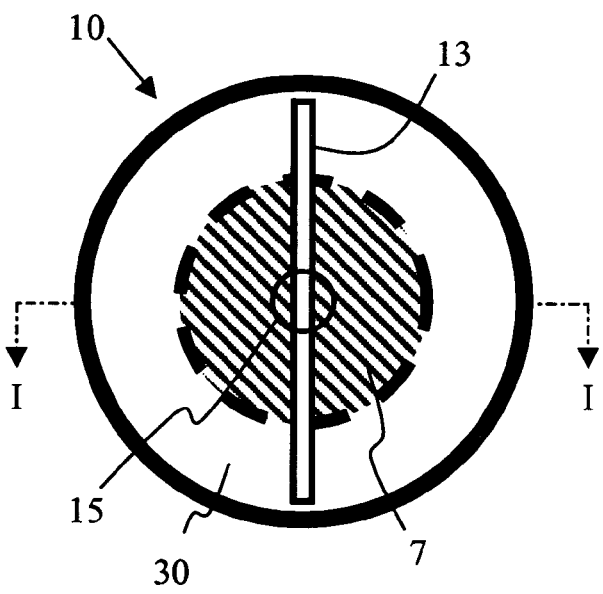
FIG. 1A is a plane view showing the bottom of a single button protector of the invention.
Figure 1B:
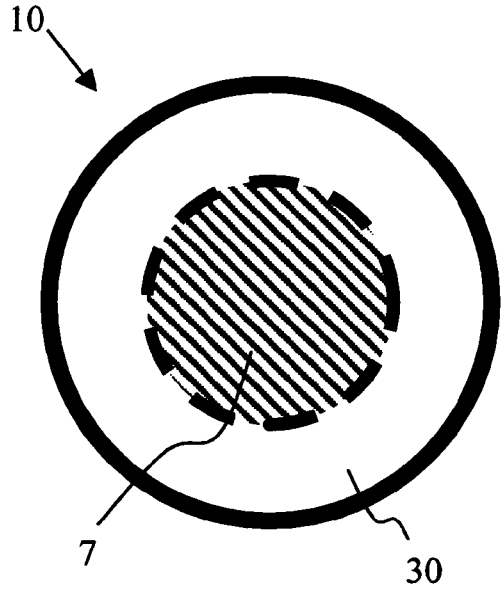
FIG. 1B is a plane view showing the top of the single button protector of FIG. 1A.
Figure 1C:
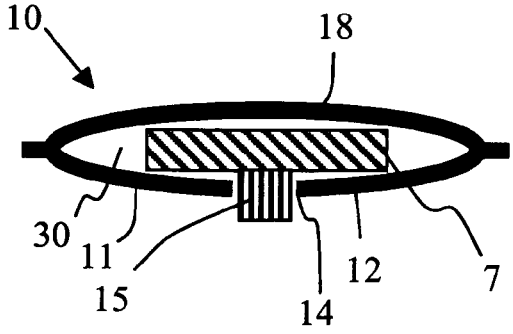
FIG. 1C is a cross-section view of the button protector of FIG. 1A taken at I—I with the button and button holding threads passing through the slit and mini-slit openings.

In FIGS. 1A–1C there is shown a single button protector of basic design with a single slit and small opening, or mini-slit, for passage of button threads that secure the button to a garment. The protector, shown generally at 10, has a substantially annular shape. Its diameter is large enough to encompass buttons having a preselected size, which would be typically encountered during washing or dry-cleaning operations. Generally, the diameter of the protector ranges from about ½ inch to 5 inches, more preferably from about ¾ inch to 2½ inches, and most preferably from about 1 to 1½ inches. The button protector has a top circular portion, or first flap 11 which is intimately bonded to a bottom circular portion, or second flap 12 to form a slit 13 which extends from an edge of the protector to a central portion, defining a cavity 30. Bonding of flap 18 to flaps 11 and 12 is accomplished using sewing and sealing, fusing, integral molding or gluing. The button 7 is inserted into the cavity 30 of the protector 10 by passing it through the slit 13. A small hole or mini-slit 14 is provided on at least one flap 11 or 12 to accommodate movement of the button-holding threads 15 during insertion of the button 7 into the cavity 30. Use of the mini-slit 14 minimizes the opening of flaps 11 and 12 in forming slit 13 during insertion of the button 7, and throughout the button's 7 residence within the cavity 30.

Figure 2A:
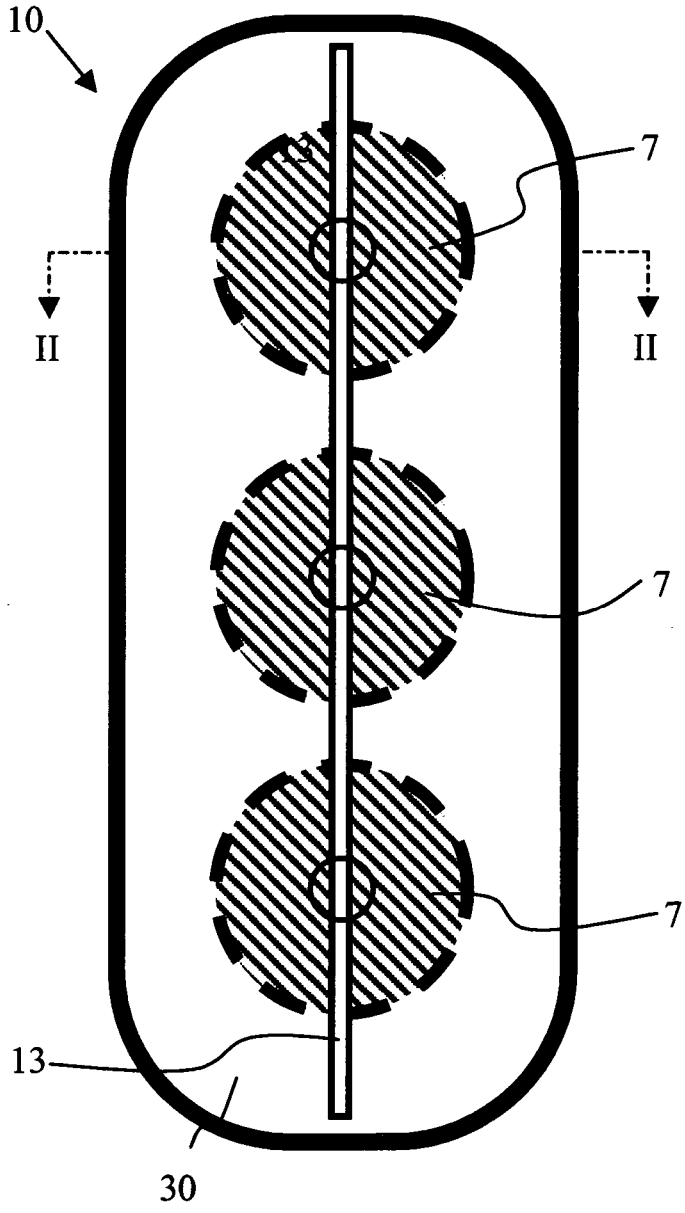
FIG. 2A is a plane view showing the bottom of a row of buttons enclosed within a button protector of the invention.
Figure 2B:
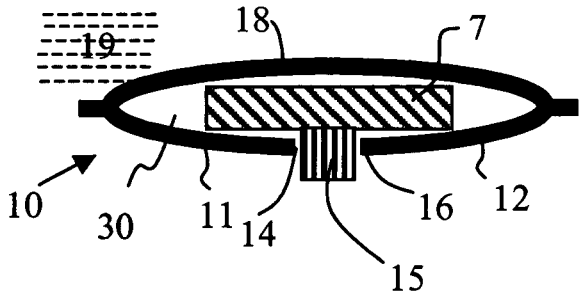
FIG. 2B is a cross-section view of the button protector of FIG. 2A taken at II—II and showing a common slit with button holding threads passed through a common slit and mini-slit openings.

Referring to FIGS. 2A–2B of the drawings, the button protector, shown generally at 10, is adapted to surround and protect a plurality of buttons. Common slit 13 accommodates entry of at least two buttons 7. Flaps 11 and 12 surround the buttons 7, which reside within the cavity 30. The threads 15 holding each buttons 7 to the garment (not shown) pass through the slit 13 and the mini-slit 14 during insertion of the buttons 7 through slit 13. During insertion of the buttons 7 and throughout their residence in cavity 30, the size of the opening created by slit 13 is minimized by the presence of the mini-slit 14. In some cases, the mini-slits 14 are custom drilled to accommodate placement of buttons on a garment. For these cases, the edges of the mini-slits 14 are preferably coated with a deformable soft silicone polymer 16 to accommodate movement of the threads 15, while minimizing penetration of cleaning fluids 19 into the cavity 30.

Figure 3A:
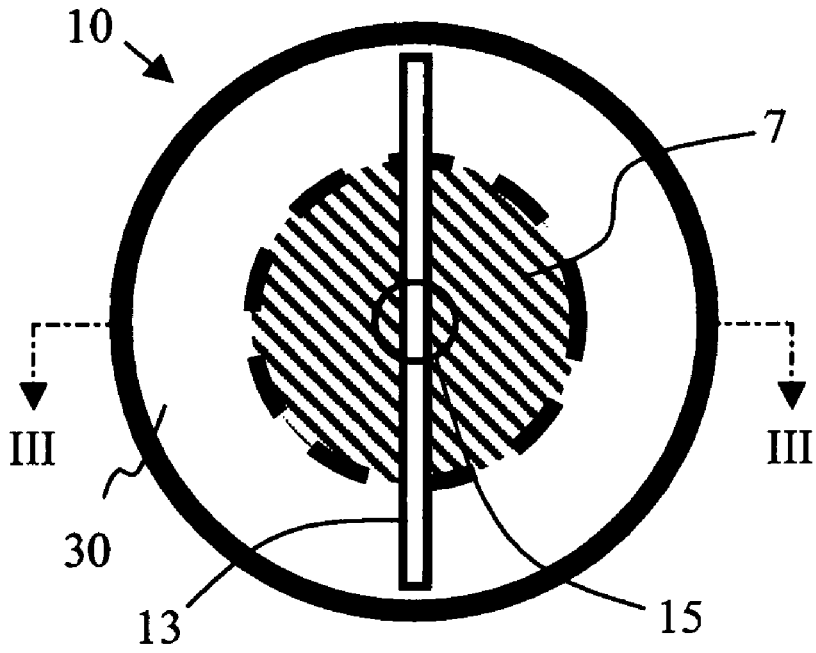
Figure 3B:
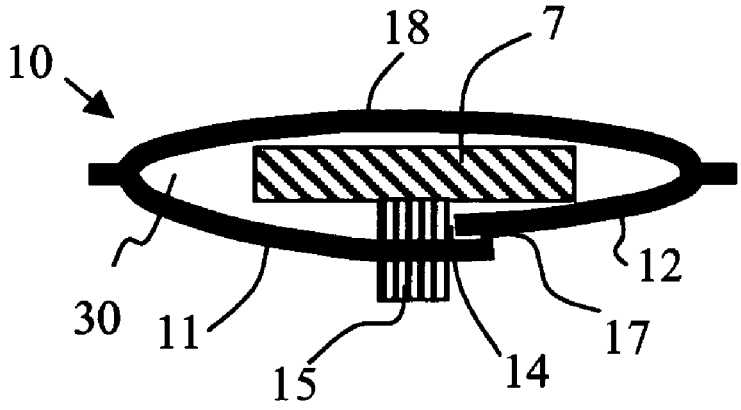
FIG. 3B is a cross-section view of the button protector of FIG. 3A taken at III—III and showing overlappinq side elements of a slit opening which define a slit and mini-slit for passage of button holding threads therethrough.

Referring to FIGS. 3A–3B of the drawings, there is shown a single button protector having a slit arrangement wherein two flaps 11 and 12, forming a slit 13, with an overlap at 17. This overlap 17 causes the enclosed area to be protected from any cleaning fluid penetration, as shown by the cross section at III—III. In operation, the button protector is placed over a button, and the enclosed area is filled with air. The protected button and clothing are then immersed in laundering or dry-cleaning fluids. Advantageously, the hydrostatic pressure produced by the fluids exceeds the atmospheric pressure in the cavity 30, causing the flaps 11 and 12 to remain tightly closed. The mini-slit 14 accommodates movement of threads 15 during insertion of the button 7, and throughout its residence within the cavity 30. Mini-flaps, disposed adjacent top and bottom sides of flap 11, so as to overlap substantially the entire length of the mini-slit 14, have sufficient flexibility so that the threads 15 passing through the mini-slit 14 are substantially surrounded and sealed from the cleaning fluids by elastic deformation. The overlapping mini-flaps are preferably composed of a deformable silicone.

Figure 4A:
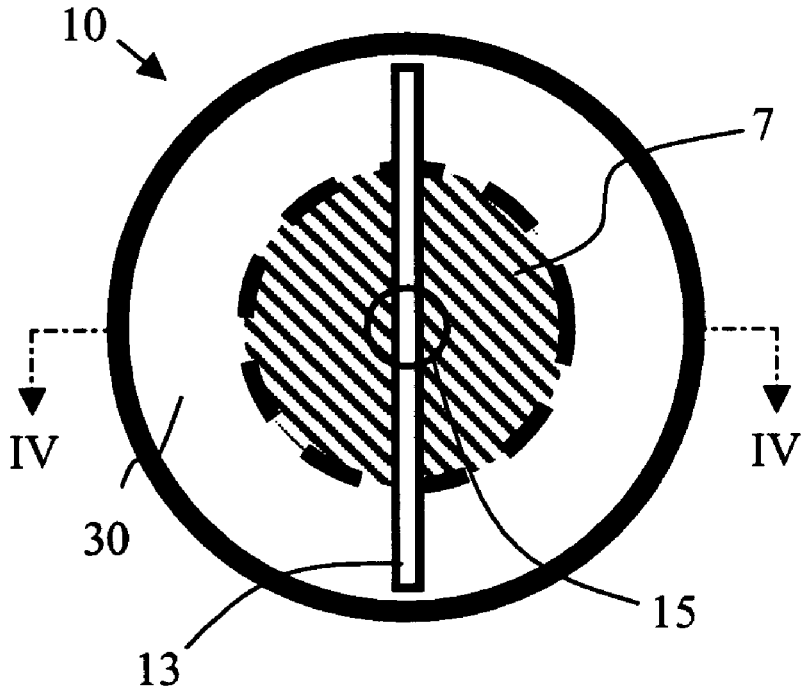
FIG. 4A is a plane view showing the bottom of a single button protector of the invention; with the button and button holding threads passing through the slit and mini-slit openings.
Figure 4B:
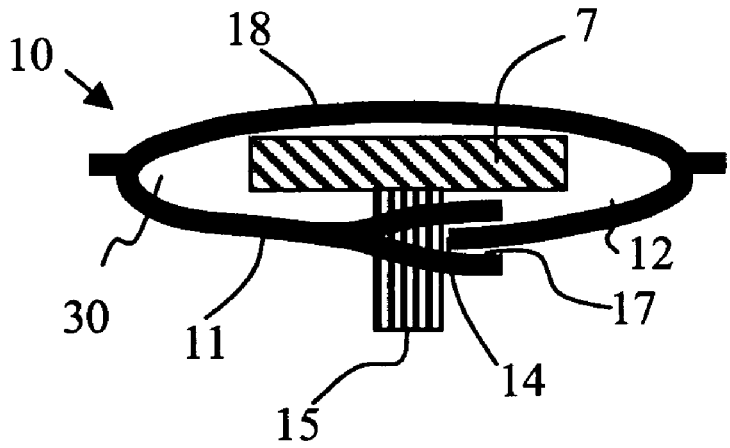
FIG. 4B is a cross-section view of the button protector of FIG. 4A taken at IV—IV depicting complete overlap by one of the slit-forming sides.

FIGS. 4A–4B show a button protector having a slit arrangement such that one edge of the slit is covered on its upper and lower side by overlapping flaps. Such overlapping flaps are shown at 17 by cross section IV—IV of FIG. 4B. With this arrangement, substantially complete protection is provided against penetration of the cavity 30 by cleaning fluids, during garment cleaning operations that subject the button protector to harsh mechanical conditions. In use of the FIG. 4 embodiment, to protect a plurality of buttons aligned in one or more rows, it is difficult to drill the mini-slits 14 in positions that accommodate the threads 15 holding each of the aligned buttons 7. For this embodiment of the button protector 10 it has been found advantageous to form each of the top and bottom-overlapping flaps 11 and 12 defining slit 13 from deformable soft flexible silicone.

The button protector may be produced in one piece by blow molding methods, and slit machined after the molding operation. Alternatively, the top portion and the bottom portion with the slit 13 may be manufactured separately, and thereafter boded by gluing, welding, sewing and sealing, and the like. Construction materials used when forming the protector preferably comprise laundering and dry-cleaning repellent materials, such as fluorocarbons, silicone compositions or fabrics coated with silicone or fluorocarbon polymer coatings.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A flexible detachable button protector, comprising:

a. enclosure means for forming a cavity surrounding at least one button, said enclosure means having an outer edge, said enclosure means having a top and a bottom, wherein said outer edge and said top and bottom of said enclosure means are substantially sealed so that said cavity is substantially sealed;

b. slit means for accommodating insertion of said button into said cavity, said slit means having a first slit outer edge and a second slit outer edge, said slit means extending vertically from said top to said bottom of said enclosure means, said slit means comprises a plurality of mini-flaps disposed in overlapping relation along substantially an entire length of said first slit outer edge, wherein said mini-flaps comprise an upper and lower mini-flap adjacent to one another arranged to form a v-shaped housing adjacent to said second slit outer edge and being appointed to receive and house said second slit outer edge to minimize entry of laundry and dry-cleaning fluids into said cavity;

c. mini-slits extending horizontally from a portion on said second slit outer edge of said slit means of said enclosure means, said mini-slit being located central of said cavity and being appointed for accommodating movement of threads attaching said button to a garment during insertion of said button into said cavity;

d. sealing means operable by elastic deformation at the edges of said slit means for preventing penetration of cleaning fluids into said cavity;

e. heat resistant means for preventing deterioration of said detachable button protector; and f. a surface containing a fluid repellant coating for repelling laundry and dry-cleaning fluids;

whereby said flexible detachable button protector seals by elastic deformation against cleaning fluids entering the said button cavity even after repeated exposure to heat and chemicals.

2. A button protector as recited by claim 1, wherein said slit means comprises a plurality of flaps, at least one of said flaps having its facing sides coated with flexible silicone to minimize leakage of laundry and cleaning fluids into said cavity during thread movement occasioned by insertion of said button.

3. A button protector, as recited by claim 1, wherein overlapping portions of said mini-flaps are composed of flexible silicone.

4. A button protector as recited by claim 1, capable of withstanding temperatures of at least about 800° F.

5. A button protector as recited by claim 1, adapted to enclose and accommodate a plurality of buttons within said cavity.

6. A button protector as recited by claim 1, wherein said mini-slit comprises a plurality of mini-flaps, for providing flap overlap on both sides of said mini-slit, thereby minimizing penetration of laundry and dry-cleaning fluids into said cavity.

7. A button protector as recited by claim 6, wherein said overlapping portions of said mini-flaps are composed of flexible silicone.

* * * * *